US008935935B2

(12) United States Patent
Waugh et al.

(10) Patent No.: US 8,935,935 B2
(45) Date of Patent: Jan. 20, 2015

(54) METHODS FOR MONITORING SENSORS OF REFRIGERATOR APPLIANCES

(71) Applicant: General Electric Company, Schenectady, NY (US)

(72) Inventors: Joseph Thomas Waugh, Louisville, KY (US); Tyler James Doering, Louisville, KY (US); Jonathan Charles Crosby, Louisville, KY (US); Ryan Michael Hartlage, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 83 days.

(21) Appl. No.: 13/715,158

(22) Filed: Dec. 14, 2012

(65) Prior Publication Data

US 2014/0166153 A1 Jun. 19, 2014

(51) Int. Cl.
*F25B 49/00* (2006.01)
*F17D 3/00* (2006.01)

(52) U.S. Cl.
CPC ..... *F17D 3/00* (2013.01)
USPC ..... 62/132; 62/3.63; 62/389; 141/360; 222/1

(58) Field of Classification Search
USPC ..... 340/540, 603, 612, 618, 619; 141/360; 222/1; 62/3.63, 3.64, 132, 389
See application file for complete search history.

(56) References Cited

U.S. PATENT DOCUMENTS

| | | | | |
|---|---|---|---|---|
| 6,651,449 | B2 * | 11/2003 | Heims et al. | 62/98 |
| 7,201,005 | B2 * | 4/2007 | Voglewede et al. | 62/126 |
| 7,673,661 | B2 * | 3/2010 | Chase et al. | 141/360 |
| 8,109,301 | B1 * | 2/2012 | Denise | 141/360 |
| 8,443,614 | B2 * | 5/2013 | Kim | 62/3.64 |
| 8,499,578 | B2 * | 8/2013 | Ferragut et al. | 62/389 |
| 8,505,593 | B1 * | 8/2013 | Denise | 141/95 |
| 2005/0268624 | A1 * | 12/2005 | Voglewede et al. | 62/126 |
| 2008/0190127 | A1 * | 8/2008 | Cho et al. | 62/246 |
| 2008/0216504 | A1 * | 9/2008 | Kim et al. | 62/338 |
| 2008/0264092 | A1 * | 10/2008 | Chase et al. | 62/389 |
| 2010/0155415 | A1 * | 6/2010 | Ashrafzadeh et al. | 222/1 |
| 2011/0259033 | A1 * | 10/2011 | Froehlich | 62/344 |

* cited by examiner

*Primary Examiner* — Eric M Blount
(74) *Attorney, Agent, or Firm* — Dority & Manning, P.A.

(57) ABSTRACT

Methods for monitoring a sensor of a refrigerator appliance are provided. The methods include activating an auto-fill feature of the refrigerator appliance and receiving a signal from a sensor of the refrigerator appliance. The method also includes displaying a message on a display of the refrigerator appliance if the sensor does not detect the container within the dispenser recess. The message can provide a user with feedback regarding the auto-fill feature and assist the user with properly operating the auto-fill feature.

20 Claims, 7 Drawing Sheets

METHODS FOR MONITORING SENSORS OF REFRIGERATOR APPLIANCES

FIELD OF THE INVENTION

The present subject matter relates generally to refrigerator appliances with sensors for operating dispensing assemblies of the refrigerator appliances and methods for monitoring such sensors.

BACKGROUND OF THE INVENTION

Certain refrigerator appliances include a dispensing assembly for dispensing ice and/or liquid water. Such dispensing assemblies generally include an actuator, such as a button or paddle, or a sensor, such as an optical or ultrasonic sensor, for initiating a flow of ice and/or liquid water into a dispenser recess of the dispensing assembly. By pressing the actuator or triggering the sensor, a user can initiate the flow of ice and/or liquid water into a container, such as a cup or pitcher, positioned within the dispenser recess.

Certain dispensing assemblies having sensors also include features for automatically filling the container with ice and/or liquid water. The sensor can monitor a level of ice and/or liquid water within the container, and the dispensing assembly can terminate the flow of ice and/or liquid water into the container when the container is full or at a predetermined level. For such auto-fill features to operate properly, the sensor measures the container and its contents accurately and precisely. In particular, sensors measure various parameters of the container in order to automatically fill the container with ice and/or liquid water. Such parameters can include an alignment of the container, a location of a container lip, a location of a container bottom, and a height of liquid water and/or ice within the container relative to the container lip or container bottom.

Sensors can have difficulty accurately and precisely measuring such parameters. In particular, containers have a multitude of sizes and shapes, and accurately and precisely measuring such parameters across such a spectrum of containers can be difficult. In turn, such difficulty can lead to user frustration and dissatisfaction because the automatic fill process may not operate properly due to unacceptable measurements from the sensor.

Accordingly, methods for facilitating automatic filling of a container with ice and/or liquid water would be useful. In particular, methods for assisting a user with properly operating a dispenser of a refrigerator appliance during automatic filling of a container with ice and/or liquid water would be useful.

BRIEF DESCRIPTION OF THE INVENTION

The present subject matter provides methods for monitoring a sensor of a refrigerator appliance. The methods include activating an auto-fill feature of the refrigerator appliance and receiving a signal from a sensor of the refrigerator appliance. The method also includes displaying a message on a display of the refrigerator appliance if the sensor does not detect the container within the dispenser recess. The message can provide a user with feedback regarding the auto-fill feature and assist the user with properly operating the auto-fill feature. Additional aspects and advantages of the invention will be set forth in part in the following description, or may be apparent from the description, or may be learned through practice of the invention.

In a first exemplary embodiment, a method for monitoring a sensor of a refrigerator appliance is provided. The sensor is directed towards a dispenser recess of the refrigerator appliance. The refrigerator appliance also has a display. The method includes activating an auto-fill feature of the refrigerator appliance, presenting a place container within the dispenser recess message on the display of the refrigerator appliance, receiving a signal from the sensor of the refrigerator appliance, and displaying a container not detected message on the display of the refrigerator appliance if the sensor does not detect the container within the dispenser recess at the step of receiving.

In a second exemplary embodiment, a method for monitoring a sensor of a refrigerator appliance is provided. The sensor is directed towards a dispenser recess of the refrigerator appliance. The refrigerator appliance also has a display. The method includes activating an auto-fill feature of the refrigerator appliance, scanning the dispenser recess of the refrigerator appliance with the sensor of the refrigerator appliance after the step of activating, and displaying an error message on the display of the refrigerator appliance if a container is not detected within the dispenser recess of the refrigerator appliance by the sensor of the refrigerator appliance during the step of scanning.

In a third exemplary embodiment, a method for monitoring a sensor of a refrigerator appliance is provided. The sensor is directed towards a dispenser recess of the refrigerator appliance. The refrigerator appliance also has a display. The method includes initiating an auto-fill process of the refrigerator appliance, scanning the dispenser recess of the refrigerator appliance with the sensor of the refrigerator appliance after the step of initiating, determining a subsequent step of the auto-fill process based at least in part on the step of scanning, and displaying the subsequent step of the auto-fill process on the display of the refrigerator appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
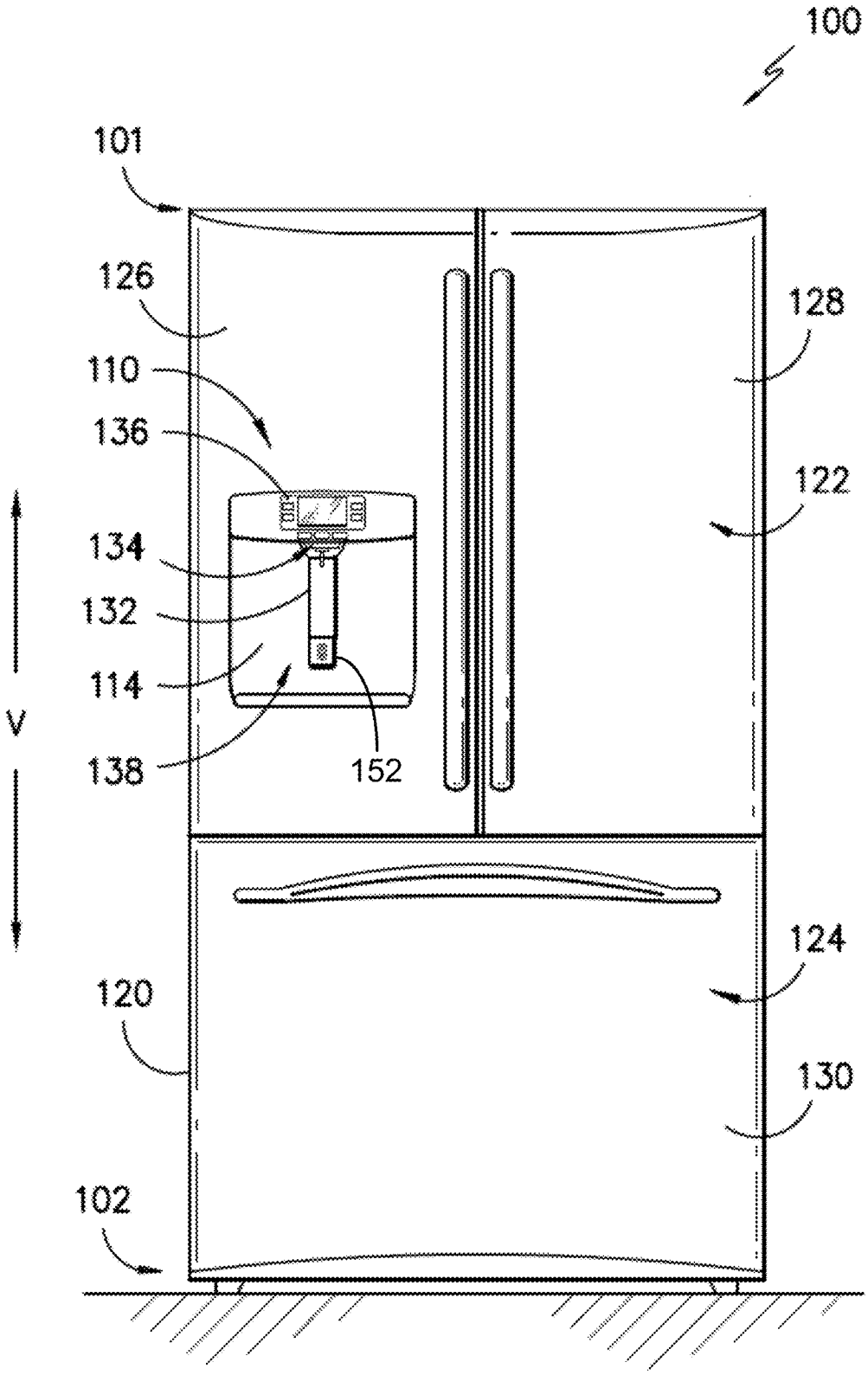
FIG. 1 provides a front, elevation view of an exemplary embodiment of a refrigerator appliance suitable for use with the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, elevation view of an exemplary embodiment of a refrigerator appliance 100 suitable for use with the present subject matter. Refrigerator appliance 100 defines a vertical direction V and extends between an upper portion 101 and a lower portion 102 along the vertical direction V. Refrigerator appliance 100 includes a cabinet or housing 120 that defines chilled chambers for receipt of food items for storage. In particular, refrigerator appliance 100 defines a fresh food chamber 122 at upper portion 101 of refrigerator appliance 100 and a freezer chamber 124 arranged below fresh food chamber 122 on the vertical direction V, e.g., at lower portion 102 of refrigerator appliance 100. As such, refrigerator appliance 100 is generally referred to as a bottom mount refrigerator appliance. However, using the teachings disclosed herein, one of skill in the art will understand that the present subject matter may be used with other types of refrigerator appliances (e.g., side-by-side style or top mount style) or a freezer appliance as well. Consequently, the description set forth herein is for illustrative purposes only and is not intended to limit the present subject matter in any aspect.

Refrigerator doors 126 and 128 are rotatably hinged to an edge of housing 120 for accessing fresh food compartment 122. A freezer door 130 is arranged below refrigerator doors 126 and 128 for accessing freezer chamber 124. Freezer door 130 is coupled to a freezer drawer (not shown) slidably mounted within freezer chamber 124.

Refrigerator appliance 100 also includes a dispensing assembly 110 for dispensing water and/or ice. Dispensing assembly 110 includes a dispenser 114 positioned on or mounted to an exterior portion of refrigerator appliance 100, e.g., on refrigerator door 126. Dispenser 114 includes a discharging outlet 134 for accessing ice and water. A paddle or actuator 132 is mounted below discharging outlet 134 for operating dispenser 114. In alternative exemplary embodiments, any suitable actuator may be used to operate dispenser 114, such as a button. A user interface panel 136 is provided for controlling the mode of operation. For example, user interface panel 136 includes a water dispensing button (not labeled) and an ice-dispensing button (not labeled) for selecting a desired mode of operation such as crushed or non-crushed ice.

Discharging outlet 134 and actuator 132 are an external part of dispenser 114 and are mounted in a dispenser recess 138 defined in an outside surface of refrigerator door 126. Dispenser recess 138 is positioned at a predetermined elevation convenient for a user to access ice or water and enabling the user to access ice without the need to bend-over and without the need to access freezer chamber 124. In the exemplary embodiment, dispenser recess 138 is positioned at a level that approximates the chest level of a user.

Dispenser assembly 110 also includes a first ultrasonic sensor 152 mounted to dispenser 114 and positioned within or adjacent dispenser recess 138. First ultrasonic sensor 152 is directed towards dispenser recess 138 and is configured for detecting a container within dispenser recess 138. First ultrasonic sensor 152 is discussed in greater detail below.

Figure 2:
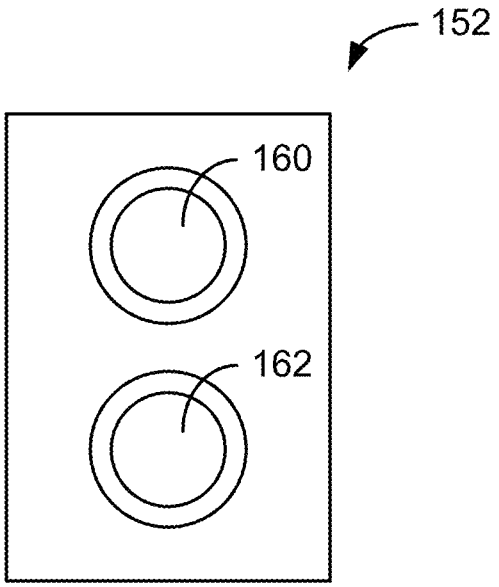
FIG. 2 provides a front, elevation view of an ultrasonic sensor of the refrigerator appliance of FIG. 1.

FIG. 2 provides a front, elevation view of first ultrasonic sensor 152 of refrigerator appliance 100. First ultrasonic sensor 152 includes an ultrasonic transducer 160 and an ultrasonic detector 162 for detecting a proximity or location of a container within dispenser recess 138. Ultrasonic transducer 160 is configured for generating high frequency sound waves and directing such sound waves towards dispenser recess 138 and objects located therein. Conversely, ultrasonic detector 162 is configured for detecting any high frequency sound waves reflected back towards first ultrasonic sensor 152 by objects within dispenser recess 138. As will be understood by those skilled in the art, the location, shape, alignment, or contents of a container within dispenser recess 138 may be determined by the amount of time between when ultrasonic transducer 160 sends out an ultrasonic sound wave and when ultrasonic detector 162 detects a reflection of such ultrasonic sound wave.

Figure 3:
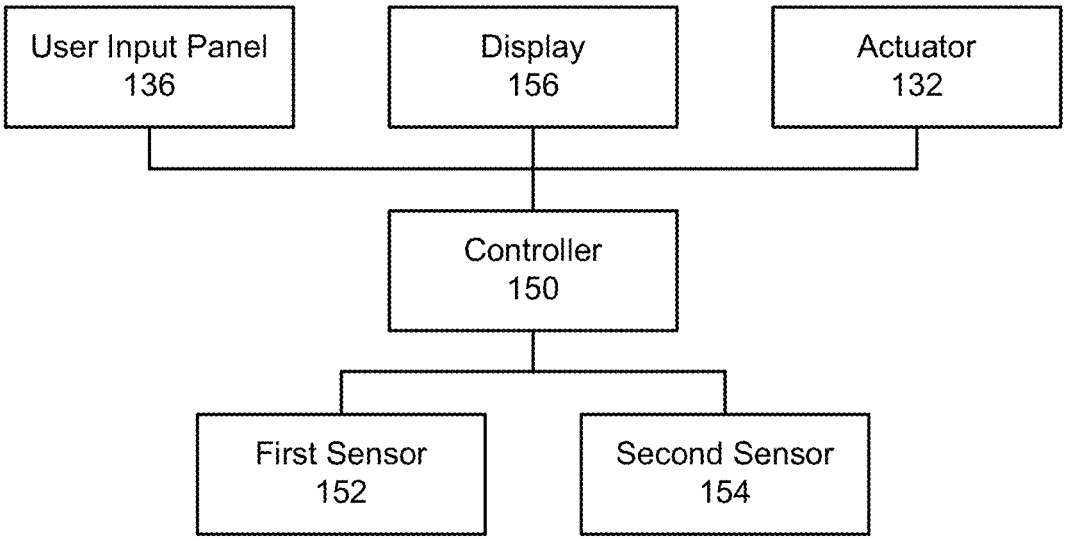
FIG. 3 provides a schematic view of the refrigerator appliance of FIG. 1.

FIG. 3 provides a schematic view of refrigerator appliance 100. As may be seen in FIG. 3, refrigerator appliance 100 also includes a second ultrasonic sensor 154. Second ultrasonic sensor 154 may be constructed in a similar manner to first ultrasonic sensor 152 and include a similar ultrasonic transducer and ultrasonic detector. Thus, second ultrasonic sensor 154 may operate in a similar manner to first ultrasonic sensor 152. Like first ultrasonic sensor 152, second ultrasonic sensor 154 is directed towards dispenser recess 138 and is configured for detecting a container within dispenser recess 138. As an example, second ultrasonic sensor 154 can be mounted to dispenser 114, e.g., above dispenser recess 138 along the vertical direction V or adjacent discharging outlet 134. Second ultrasonic sensor 154 can be configured for detecting and/or locating a lip or a bottom of a container within dispenser recess 138. Second ultrasonic sensor 154 can also be configured for determining a height of contents within the container, e.g., relative to the lip or the bottom of the container. As discussed in greater detail below, refrigerator appliance 100 also includes features for automatically filling a container within dispenser recess 138 with ice and/or liquid water. First and second ultrasonic sensors 152 and 154 can assist with such automatic filling, e.g., by sensing or detecting the container within dispenser recess 138 and locating specific portions of the container.

It should be understood that refrigerator appliance 100 can include any other suitable type of sensor for detecting or measuring a container within dispenser recess 138 in alternative exemplary embodiments. As an example, refrigerator appliance 100 can include an infrared sensor, an optical sensor, a laser sensor, a capacitive sensor, an inductive sensor, or suitable combinations thereof. Thus, although discussed in the context of first and second ultrasonic sensors 152 and 154, it should be understood that such examples are provided by way of example only and are not intended to limit the present subject matter in any aspect.

Refrigerator appliance 100 further includes a controller 150. Operation of the refrigerator appliance 100 is regulated by controller 150 that is operatively coupled to control panel 138. In one exemplary embodiment, control panel 138 may represent a general purpose I/O ("GPIO") device or functional block. As discussed in greater detail below, control panel 138 includes input components, such as one or more of a variety of electrical, mechanical or electro-mechanical input devices including rotary dials, push buttons, and touch pads. Control panel 138 may be in communication with controller 150 via one or more signal lines or shared communication busses.

Control panel 138 provides selections for user manipulation of the operation of refrigerator appliance 100. In response to user manipulation of the control panel 138, controller 150 operates various components of refrigerator appliance 100. For example, controller 150 is operatively coupled or in communication with actuator 132, user input panel 136, first ultrasonic sensor 152, and a second ultrasonic sensor 154, such that controller 150 can operate such components. In particular, controller 150 is in communication with first and second ultrasonic temperature sensors 152 and 154 and may receive signals from such components. Controller 150 can receive such signals in order to detect or locate a container within dispenser recess 138 as discussed above.

Controller 150 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 4:
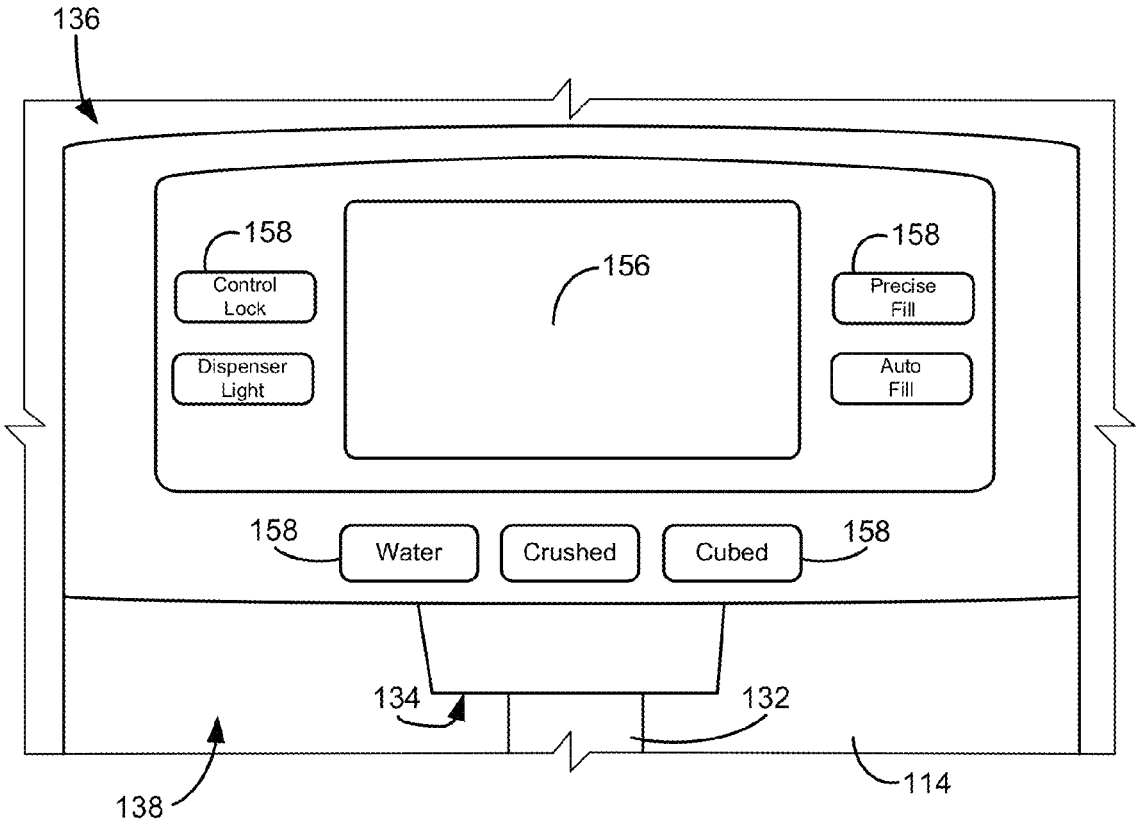
FIG. 4 provides a partial front, elevation view of a dispenser of the refrigerator appliance of FIG. 1.

FIG. 4 provides a partial front, elevation view of dispenser 114 of refrigerator appliance 100. As may be seen in FIG. 4, control panel 136 of dispenser 114 includes a display 156. Display 156 is configured for presenting or displaying messages thereon. Display 156 can be any suitable device for displaying an image. For example, display 156 can be a liquid crystal display or a plasma display.

Control panel 136 also includes a plurality of user inputs 158. User inputs 158 may be any suitable device for permitting a user to input commands to controller 150. For example, user inputs 158 can be electrical, mechanical or electro-mechanical input devices including rotary dials, push buttons, and touch pads or combinations thereof. Each user input of user inputs 158 corresponds to a particular command or instruction for controller 150. For example, as may be seen in FIG. 4, one of user inputs 158 is configured for selecting dispensing of crushed ice. Similarly, another one of user inputs 158 is configured for selecting dispensing of cubed ice, and yet another one of user inputs 158 is configured for selecting dispensing of liquid water. An additional one of user inputs 158 is configured for initiating automatic filling of a container positioned within dispenser recess 138 as discussed in greater detail below.

Figure 5:
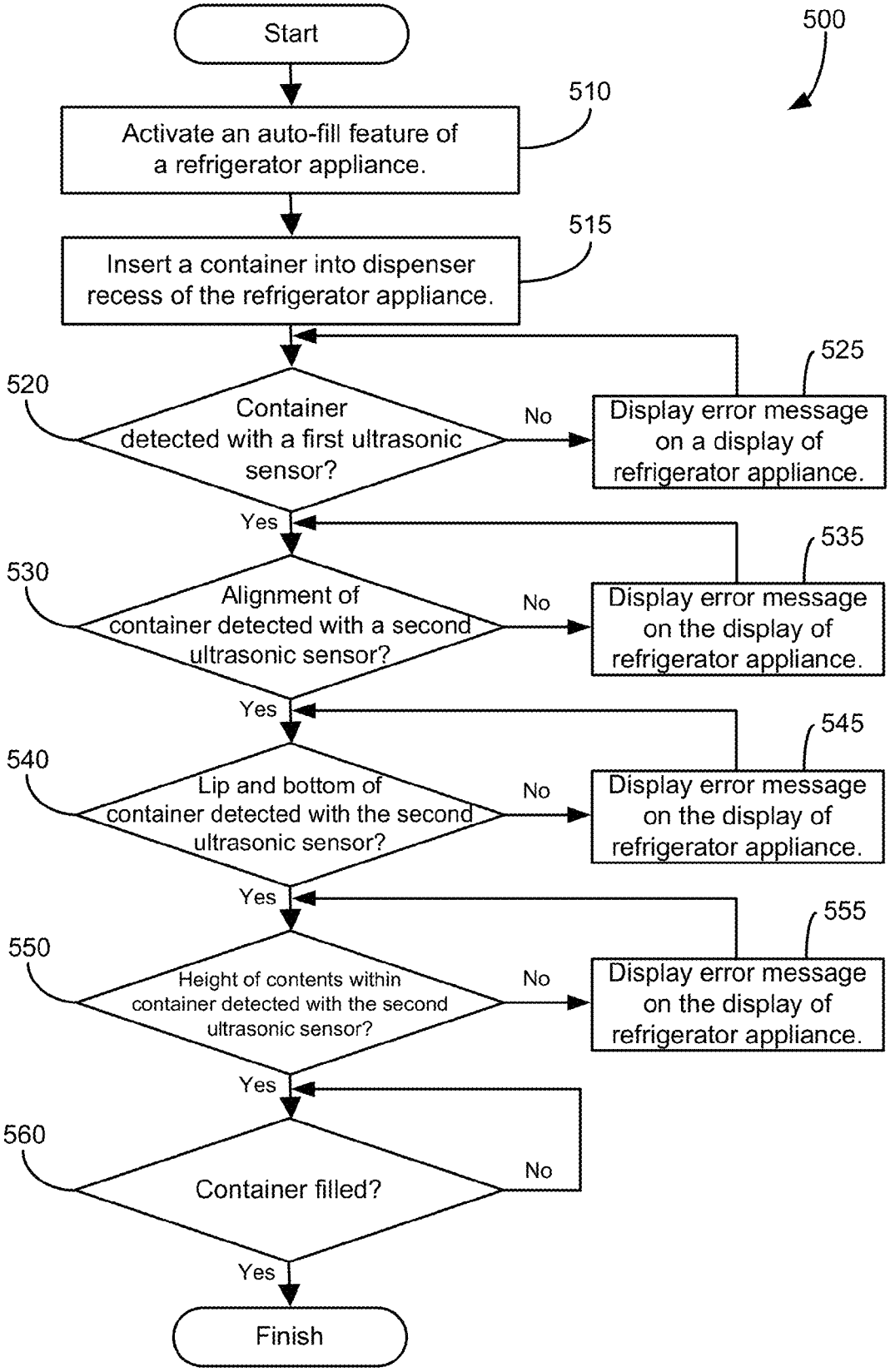
FIG. 5 illustrates a method for automatically filling a container positioned within a dispenser recess of a refrigerator appliance according to an exemplary embodiment of the present subject matter.

FIG. 5 illustrates a method 500 for automatically filling a container positioned within a dispenser recess of a refrigerator appliance according to an exemplary embodiment of the present subject matter. As an example, controller 150 of refrigerator appliance 100 can be programmed to implement portions of method 500. Thus, method 500 can be used for automatically filling a container positioned within dispenser recess 138 of refrigerator appliance 100. In addition, method 500 can provide feedback to a user of refrigerator appliance 100, e.g., regarding progress of the automatic filling process or errors within the same. Such feedback can improve performance of refrigerator appliance 100 during the automatic filling process as discussed in greater detail below.

As an example, to provide feedback to a user of refrigerator appliance 100, display 156 can present various messages thereon. FIGS. 8-15 illustrate various exemplary embodiments of messages suitable for use with the present subject matter and for presentation on display 156 of refrigerator appliance 100. It should be understood that the messages illustrated in FIGS. 8-15 are provided by way of example only and are not intended to limit the present subject matter in any aspect. Thus, other suitable alternative messages may be presented on display 156 in alternative exemplary embodiments. For example, messages having different layouts, text, information, or instructions may be presented on display 156 in alternative exemplary embodiments. Also, messages may be shown in a list on single screen rather than as separate screens in alternative exemplary embodiments. Messages shown in FIGS. 8-15 are discussed in greater detail below.

At step 510, an auto-fill process of refrigerator appliance 100 is initiated. As an example, a user can push one of user inputs 158 in order to signal controller 150 to initiate the auto-fill process. At step 515, a container, such as a cup or glass, is inserted into dispenser recess 138. Display 156 can also present a message 800 (FIG. 8) to the user on display 156 in order to instruct the user to insert the container into dispenser recess 138 after the auto-fill process is initiated at step 515.

With the container positioned within dispenser recess 138, dispenser recess 138 is scanned with first ultrasonic sensor 152 at step 520. Further, a subsequent step of the auto-fill process is determined at step 520, and the subsequent step of the auto-fill process is present on display 156 at step 525. In particular, if first ultrasonic sensor 152 does not detect the container within dispenser recess 138, display 156 presents a message 900 (FIG. 9) to the user at step 525 in order to inform the user that the container was not detected with first ultrasonic sensor 152, and first ultrasonic sensor 152 also rescans dispenser recess 138 to attempt to detect the container again. Conversely, if first ultrasonic sensor 152 does detect the container within dispenser recess 138, second ultrasonic sensor 154 scans the container as discussed in greater detail below.

At step 530, controller 150 detects an alignment of the container within dispenser recess 138 based at least in part on a signal or signals from second ultrasonic sensor 154. If second ultrasonic sensor 154 does not detect the alignment of the container at step 530, display 156 presents a message 1000 (FIG. 10) to the user at step 535. Message 1000 informs the user that the alignment was not detected with second ultrasonic sensor 154 and instructs the user to reposition the container within dispenser recess 138. Second ultrasonic sensor 154 also rescans dispenser recess 138 at step 535 to attempt to determine the alignment of the container, e.g., after the user adjust the container within dispenser recess 138. Conversely, if second ultrasonic sensor 154 does detect the container within dispenser recess 138, controller 150 detects a bottom and a lip of the container within dispenser recess 138 based at least in part on a signal or signals from second ultrasonic sensor 154 at step 540.

At step 540, if second ultrasonic sensor 154 does not detect the lip and/or bottom of the container, display 156 presents message 1000 or a message 1100 (FIG. 11) to the user at step 545. Message 1100 informs the user that the lip and/or bottom of the container was not detected with second ultrasonic sensor 154 and instructs the user to utilize a different container for the auto-fill process. Second ultrasonic sensor 154 also rescans dispenser recess 138 at step 545, e.g., to attempt to detect the lip and/or bottom of the container or the lip and/or bottom of the different container. Conversely, if second ultrasonic sensor 154 does detect the lip and/or bottom of the container within dispenser recess 138, controller 150 initiates a flow of liquid water and/or ice into the container and detects a height of contents, such as liquid water and/or ice, within the container based at least in part on a signal or signals from second ultrasonic sensor 154 at step 550.

When controller 150 initiates the flow of liquid water and/or ice into container, display 156 presents a message 1200 (FIG. 12) to the user. Message 1200 informs the user that liquid water and/or ice is flowing into the container and instructs the user to not move the container. At step 550, if second ultrasonic sensor 154 does not detect the height of contents within the container, display 156 presents a message 1300 (FIG. 13) or a message 1400 (FIG. 14) to the user at step 555. Message 1300 is presented if the container moves within dispenser recess 138 and instructs the user to steady the container. Message 1400 is presented if second ultrasonic sensor 154 does not detect the height of contents within the container changing over time and queries the user if the container is full or overflowing. Second ultrasonic sensor 154 also rescans dispenser recess 138 to attempt to detect the height of contents within the container at step 555.

At step 560, the flow of liquid water and/or ice into the container continues until the container is full. When the container is full, display 156 presents a message 1500 (FIG. 15) to the user informing the user that the auto-fill process is complete.

Messages 800, 900, 1000, 1100, 1200, 1300, 1400, and 1500 can assist a user with operating dispenser 114 during the auto-fill process. In particular, messages 800, 900, 1000, 1100, 1200, 1300, 1400, and 1500 can provide feedback to the user regarding potential solutions to errors during the auto-fill process and also notify the user of progress of the auto-fill process and when the auto-fill process is complete. In such a manner, user satisfaction with refrigerator appliance 100 can be improved and operation of refrigerator appliance 100 can be improved as well.

Figure 6:
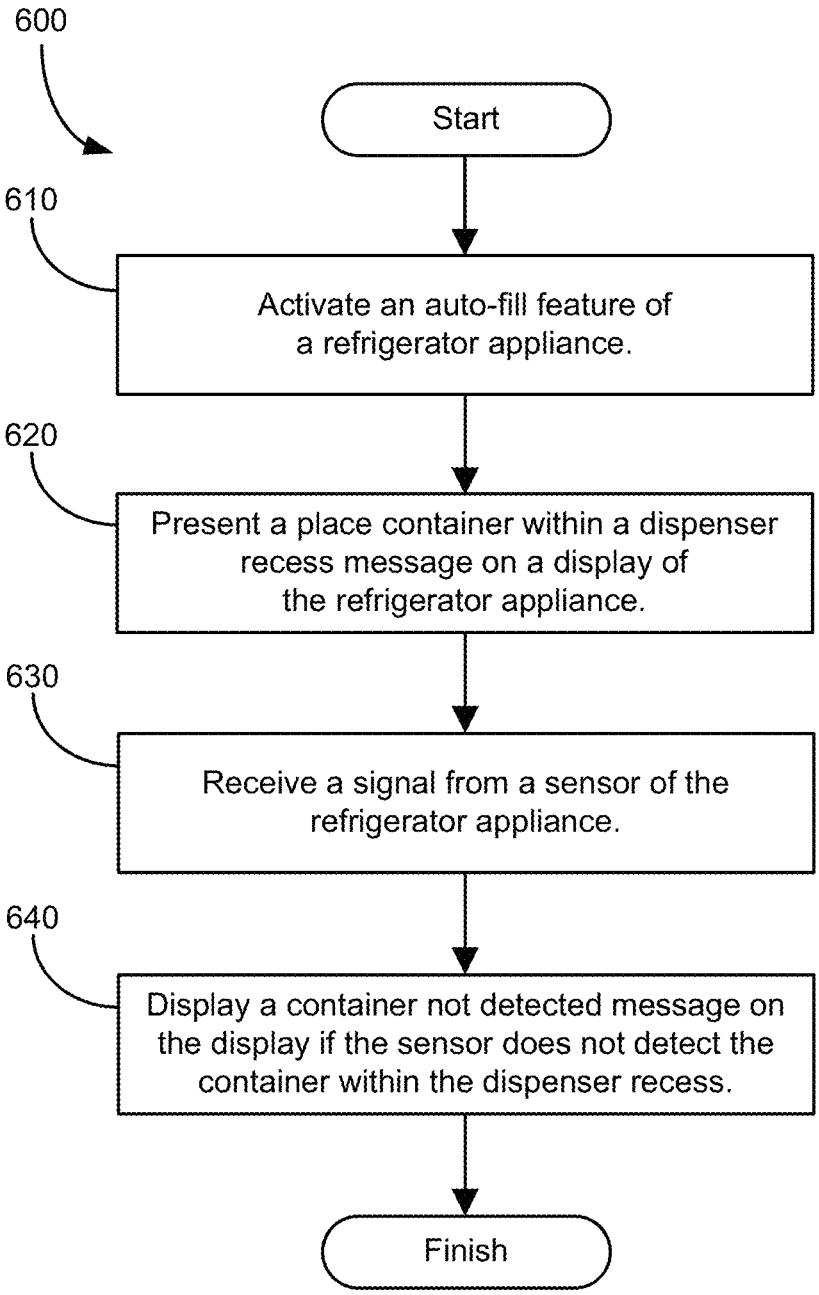
FIG. 6 illustrates a method for monitoring a sensor of a refrigerator appliance according to an exemplary embodiment of the present subject matter.

FIG. 6 illustrates a method 600 for monitoring a sensor of a refrigerator appliance according to an exemplary embodiment of the present subject matter. Method 600 can be utilized with any suitable refrigerator appliance. As an example, method 600 can be programmed into controller 150 of refrigerator appliance 100 such that controller 150 implements method 600.

Controller 150 may monitor first ultrasonic sensor 152 and/or second ultrasonic sensor 154 of refrigerator appliance 100 (FIG. 3) utilizing method 600. Thus, method 600 is described below in the context of monitoring first ultrasonic sensor 152 and second ultrasonic sensor 154. However, it should be understood that method 600 may be used to monitor any suitable sensor, such as an infrared sensor, an optical sensor, a laser sensor, a capacitive sensor, or an inductive sensor, e.g., directed towards dispenser recess 138 of refrigerator appliance 100 for assisting operation of dispenser 114. Method 600 can improve performance of and user satisfaction with refrigerator appliance 100 as discussed in greater detail below.

At step 610, controller 150 activates an auto-fill feature of refrigerator appliance 100. As an example, controller 150 can active the auto-fill feature in response to a user triggering one of user inputs 158. At step 620, display 156 presents a place container within the dispenser recess message, e.g., message 800 (FIG. 8), to a user. In response to the place container within the dispenser recess message, the user can place a container within dispenser recess 138.

At step 630, controller 150 receives a signal or signals from first ultrasonic sensor 152. In particular, ultrasonic transducer 160 can emit ultrasonic waves at step 630, and ultrasonic detector 162 can send the signal to controller 150 in response to ultrasonic waves received by ultrasonic detector 162.

At step 640, controller 150 displays a container not detected message, e.g., message 900 (FIG. 9), on display 156 if first ultrasonic sensor 152 does not detect the container within dispenser recess 138 at step 630. Conversely, controller 150 displays a container detected message on display 156 if first ultrasonic sensor 152 detects the container within dispenser recess 138 at step 630. Such messages can assist a user with operating dispenser 114 during the auto-fill process. In particular, such messages can provide feedback to the user regarding potential solutions to errors during the auto-fill process and also notify the user of progress of the auto-fill process. In such a manner, user satisfaction with refrigerator appliance 100 can be improved and operation of refrigerator appliance 100 can be improved as well.

In addition to messages, a plot of the signal from first ultrasonic sensor 152 can be presented on display 156 if first ultrasonic sensor 152 does not detect the container within dispenser recess 138 at step 630 in certain exemplary embodiments. A technician repairing or servicing refrigerator appliance 100 can utilize the plot of the signal to diagnose potential issues or problems with refrigerator appliance 100 and first ultrasonic sensor 152. In a similar manner, plots of signals from second ultrasonic sensor 154 can also be presented on display 156.

In additional exemplary embodiments, controller 150 can save a fault code in a memory, such as the memory of controller 150, if first ultrasonic sensor 152 does not detect the container within dispenser recess 138 at step 630. By saving the fault code each time first ultrasonic sensor 152 does not detect the container within dispenser recess 138, a history of such occurrences can be established, and the history can assist a technician with repairing or servicing refrigerator appliance 100 and first ultrasonic sensor 152. For example, if the same fault code is saved during each auto-fill process, the source of the fault may be easier to identify. In a similar manner, controller 150 can save fault codes for second ultrasonic sensor 154.

In additional exemplary embodiments, controller 150 obtains a signal from second ultrasonic sensor 154. Further, controller 150 shows a container alignment not determined message, e.g., message 1000 (FIG. 10), on display 156 if second ultrasonic sensor 154 does not detect the alignment of the container. Conversely, controller 150 shows a container alignment determined message on display 156 if second ultrasonic sensor 154 detects the alignment of the container.

Figure 7:
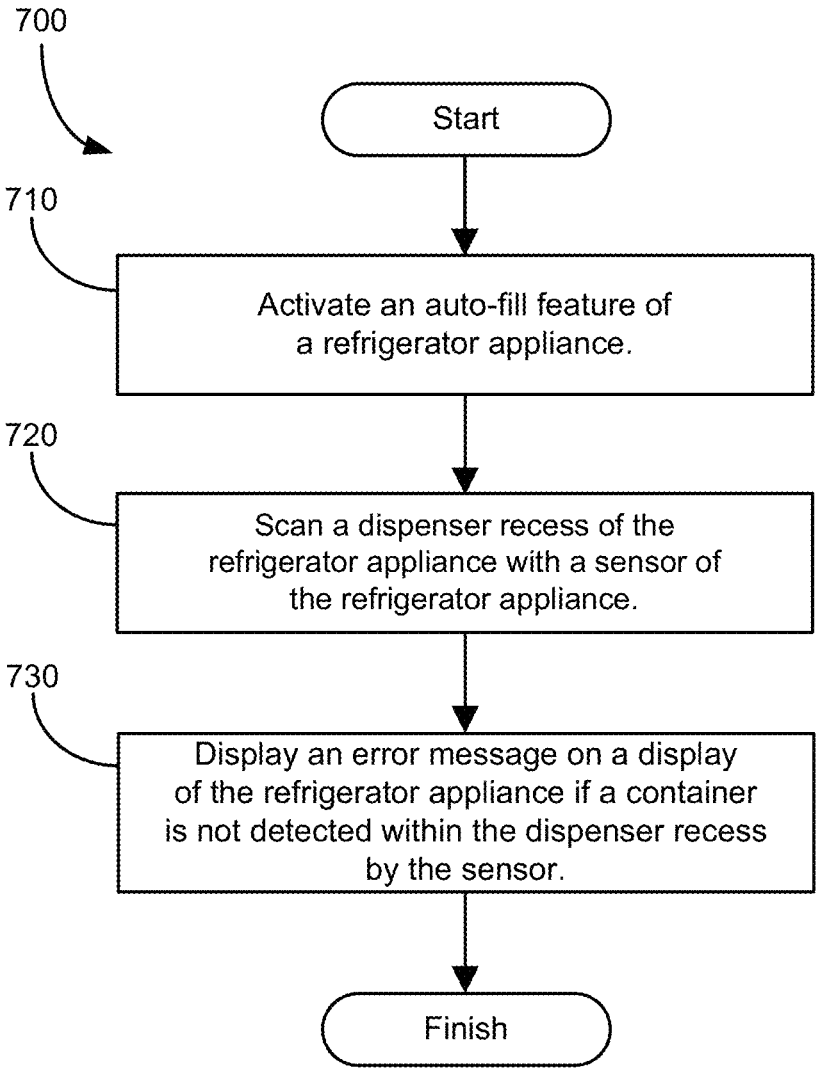
FIG. 7 illustrates an additional method for monitoring a sensor of a refrigerator appliance according to an exemplary embodiment of the present subject matter.
Figure 8:
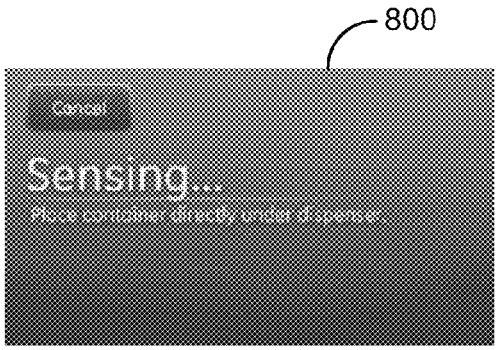
FIGS. 8-15 illustrate various exemplary embodiments of messages suitable for use with the present subject matter and presentation on a display of a refrigerator appliance.
Figure 9:
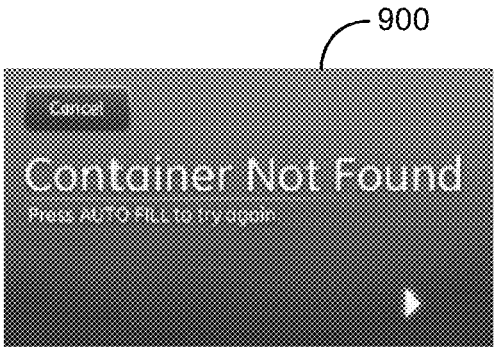
Figure 10:
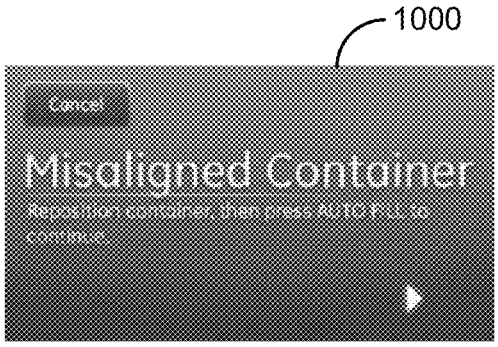
Figure 11:
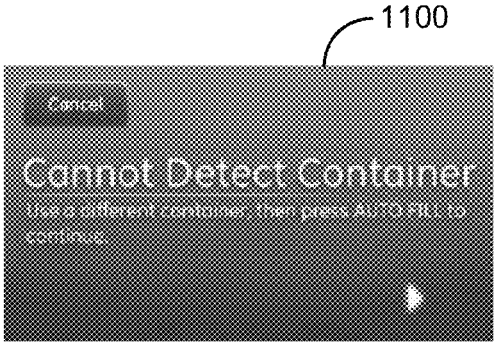
Figure 12:
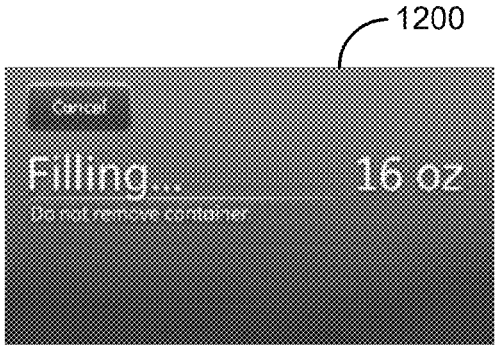
Figure 13:
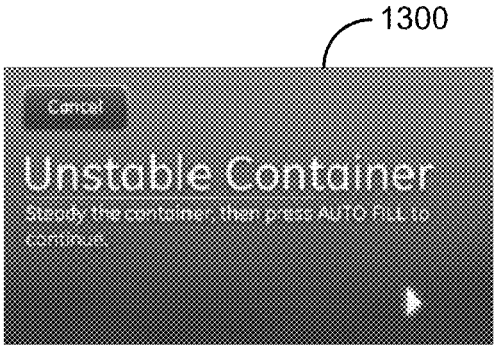
Figure 14:
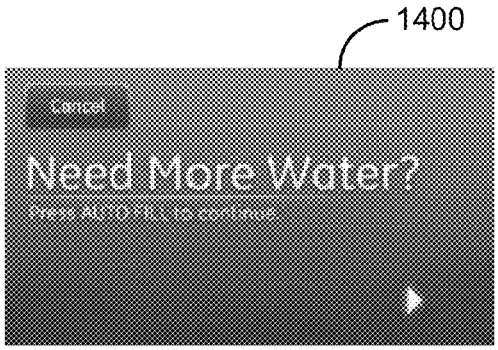
Figure 15:
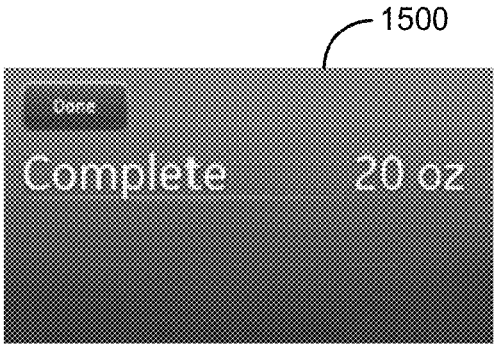

FIG. 7 illustrates an additional method 700 for monitoring a sensor of a refrigerator appliance according to an exemplary embodiment of the present subject matter. Method 700 can be utilized with any suitable refrigerator appliance. As an example, method 700 can be programmed into controller 150 of refrigerator appliance 100 such that controller 150 implements method 700.

Controller 150 may monitor first ultrasonic sensor 152 and/or second ultrasonic sensor 154 of refrigerator appliance 100 (FIG. 3) utilizing method 700. Thus, method 700 is described below in the context of monitoring first ultrasonic sensor 152 and second ultrasonic sensor 154. However, it should be understood that method 700 may be used to monitor any suitable sensor, such as an infrared sensor, an optical sensor, a laser sensor, a capacitive sensor, or an inductive sensor, e.g., directed towards dispenser recess 138 of refrigerator appliance 100 for assisting operation of dispenser 114. Method 700 can improve performance of and user satisfaction with refrigerator appliance 100 as discussed in greater detail below.

At step 710, controller 150 activates an auto-fill feature of refrigerator appliance 100. As an example, controller 150 can active the auto-fill feature in response to a user triggering one of user inputs 158. At step 720, controller 150 scans dispenser recess 138 with first ultrasonic sensor 152 after step 710. As an example, ultrasonic transducer 160 can emit ultrasonic waves at step 720, and ultrasonic detector 162 can send a signal to controller 150 in response to ultrasonic waves received by ultrasonic detector 162.

At step 730, controller 150 displays an error message, e.g., message 900 (FIG. 9), on display 156 if a container is not detected within dispenser recess 138 by first ultrasonic sensor 152 during step 720. Conversely, controller 150 displays a subsequent auto-fill message on display 156 if the container is detected within dispenser recess 138 by first ultrasonic sensor 152 during step 720. As an example, the subsequent auto-fill message can inform the user that the container was detected during step 720. Alternatively, the subsequent auto-fill message can inform the user of a subsequent error in auto-fill process or that the auto-fill process is complete.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for monitoring a sensor of a refrigerator appliance, the sensor directed towards a dispenser recess of the refrigerator appliance, the refrigerator appliance also having a display, the method comprising:

activating an auto-fill feature of the refrigerator appliance;

presenting a place container within the dispenser recess message on the display of the refrigerator appliance;

receiving a signal from the sensor of the refrigerator appliance; and displaying a container not detected message and signal data received from the sensor at said step of receiving on the display of the refrigerator appliance if the sensor does not detect the container within the dispenser recess at said step of receiving.

2. The method of claim 1, wherein said step of displaying comprises displaying a container detected message on the display of the refrigerator appliance if the sensor detects the container within the dispenser recess at said step of receiving or the container not detected message on the display of the refrigerator appliance if the sensor does not detect the container within the dispenser recess at said step of receiving.

3. The method of claim 1, wherein said step of displaying comprises displaying the container not detected message and a plot of the signal from the sensor on the display of the refrigerator appliance if the sensor does not detect the container within the dispenser recess at said step of receiving.

4. The method of claim 1, further comprising saving a fault code in a memory of the refrigerator appliance if the sensor does not detect the container within the dispenser recess at said step of receiving.

5. The method of claim 1, wherein the sensor is a first sensor and the refrigerator appliance includes a second sensor directed towards the dispenser recess of the refrigerator appliance, the method further comprising:

obtaining a signal from the second sensor of the refrigerator appliance; and showing a container alignment not determined message on the display of the refrigerator appliance if the second sensor does not detect an alignment of the container within the dispenser recess at said step of obtaining.

6. The method of claim 5, wherein said step of showing comprises showing a container alignment determined message on the display of the refrigerator appliance if the second sensor detects the alignment of the container within the dispenser recess at said step of obtaining or the container alignment not determined message on the display of the refrigerator appliance if the second sensor does not detect the alignment of the container within the dispenser recess at said step of obtaining.

7. The method of claim 5, wherein said step of showing comprises showing the container alignment not determined message and a plot of the signal from the second sensor on the display of the refrigerator appliance if the second sensor does not detect the alignment of the container within the dispenser recess at said step of obtaining.

8. The method of claim 5, further comprising saving a fault code in a memory of the refrigerator appliance if the second sensor does not detect the alignment of the container within the dispenser recess at said step of obtaining.

9. The method of claim 5, further comprising producing a container lip not detected message on the display of the refrigerator appliance if the second sensor does not detect a lip of the container at said step of obtaining.

10. The method of claim 5, further comprising exhibiting a container bottom not detected message on the display of the refrigerator appliance if the second sensor does not detect a bottom of the container at said step of obtaining.

11. A method for monitoring a sensor of a refrigerator appliance, the sensor directed towards a dispenser recess of the refrigerator appliance, the refrigerator appliance also having a display, the method comprising:

activating an auto-fill feature of the refrigerator appliance;

scanning the dispenser recess of the refrigerator appliance with the sensor of the refrigerator appliance after said step of activating; and displaying an error message and signal data from the sensor on the display of the refrigerator appliance if a container is not detected within the dispenser recess of the refrigerator appliance by the sensor of the refrigerator appliance during said step of scanning.

12. The method of claim 11, wherein said step of displaying comprises displaying the error message on the display of the refrigerator appliance if the container is not detected within the dispenser recess of the refrigerator appliance by the sensor of the refrigerator appliance during said step of scanning or a subsequent auto-fill message on the display of the refrigerator appliance if the container is detected within the dispenser recess of the refrigerator appliance by the sensor of the refrigerator appliance during said step of scanning.

13. The method of claim 11, wherein said step of displaying comprises displaying the error message and a plot of data from the sensor during said step of scanning on the display of the refrigerator appliance if the container is not detected within the dispenser recess of the refrigerator appliance by the sensor of the refrigerator appliance during said step of scanning.

14. The method of claim 11, further comprising saving a fault code in a memory of the refrigerator appliance if the container is not detected within the dispenser recess of the refrigerator appliance by the sensor of the refrigerator appliance during said step of scanning.

15. The method of claim 11, wherein the sensor is a first sensor and the refrigerator appliance includes a second sensor directed towards the dispenser recess of the refrigerator appliance, the method further comprising:

probing the dispenser recess of the refrigerator appliance with the second sensor of the refrigerator appliance after said step of activating; and showing an alignment error message on the display of the refrigerator appliance if an alignment of the container within the dispenser recess of the refrigerator appliance is not determined by the second sensor of the refrigerator appliance during said step of probing.

16. The method of claim 15, wherein said step of showing comprises showing the alignment error message and a plot of data from the second sensor during said step of probing on the display of the refrigerator appliance if the alignment of the container within the dispenser recess of the refrigerator appliance is not determined by the second sensor of the refrigerator appliance during said step of probing.

17. The method of claim 15, further comprising saving a fault code in a memory of the refrigerator appliance if the alignment of the container within the dispenser recess of the refrigerator appliance is not determined by the second sensor of the refrigerator appliance during said step of probing.

18. A method for monitoring a sensor of a refrigerator appliance, the sensor directed towards a dispenser recess of the refrigerator appliance, the refrigerator appliance also having a display, the method comprising:

initiating an auto-fill process of the refrigerator appliance;

scanning the dispenser recess of the refrigerator appliance with the sensor of the refrigerator appliance after said step of initiating;

determining a subsequent step of the auto-fill process based at least in part on said step of scanning;

displaying either: (1) the subsequent step of the auto-fill process on the display of the refrigerator appliance if a container is detected within the dispenser recess of the refrigerator appliance by the sensor of the refrigerator appliance during said step of scanning; or (2) an error message and signal data from the sensor on the display of the refrigerator appliance if the container is not detected within the dispenser recess of refrigerator appliance by the sensor of the refrigerator appliance during said step of scanning.

19. The method of claim 18, wherein said step of determining comprises determining the subsequent step of the auto-fill process based at least in part on whether the sensor of the refrigerator appliance detects container within the dispenser recess during said step of scanning.

20. The method of claim 19, wherein the subsequent step comprises rescanning the dispenser recess of the refrigerator appliance with the sensor of the refrigerator appliance if the sensor of the refrigerator appliance does not detect the container within the dispenser recess during said step of scanning.

* * * * *